US007826780B2

(12) United States Patent
Deguchi

(10) Patent No.: US 7,826,780 B2
(45) Date of Patent: Nov. 2, 2010

(54) DEVELOPER CARTRIDGE

(75) Inventor: Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 434 days.

(21) Appl. No.: 12/046,843

(22) Filed: Mar. 12, 2008

(65) Prior Publication Data

US 2008/0226342 A1 Sep. 18, 2008

(30) Foreign Application Priority Data

Mar. 12, 2007 (JP) ..... 2007-062029

(51) Int. Cl.
*G03G 15/00* (2006.01)
*G03G 15/08* (2006.01)
*G03G 21/18* (2006.01)

(52) U.S. Cl. ..... 399/262; 399/25; 399/111; 399/114

(58) Field of Classification Search ..... 399/13, 399/25, 110, 111, 114, 262, 263
See application file for complete search history.

(56) References Cited

U.S. PATENT DOCUMENTS 4,913,087 A * 4/1990 Saita et al. ..... 399/12
6,654,567 B2 * 11/2003 Karakama et al. ..... 399/25
6,892,036 B2 * 5/2005 Ito ..... 399/27
7,447,469 B2 * 11/2008 Uchiyama et al. ..... 399/262
7,616,905 B2 * 11/2009 Masubuchi ..... 399/12

FOREIGN PATENT DOCUMENTS

| | | | |
|---|---|---|---|
| JP | 2002365897 A | * | 12/2002 |
| JP | 2004-061595 | | 2/2004 |
| JP | 2006-221010 | | 8/2006 |
| JP | 2006251402 A | * | 9/2006 |
| JP | 2007047399 A | * | 2/2007 |
| JP | 2008009162 A | * | 1/2008 |

* cited by examiner

*Primary Examiner*—David M Gray
*Assistant Examiner*—Fred Braun
(74) *Attorney, Agent, or Firm*—Banner & Witcoff, Ltd.

(57) ABSTRACT

A developer cartridge that can be attached to and detached from an image forming apparatus and contains developer, the developer cartridge includes: a first body that has an opening for supplying the developer; a second body that covers the first body, the second body having a conductive portion that can transmit electricity; and a memory unit that is disposed between the first body and the second body, the memory unit can be connected to a terminal of the image forming apparatus through the conductive portion of the second body, wherein the second body and the first body are movable relative to each other, the second body is able to open and close the opening by a relative movement with regard to the first body.

7 Claims, 7 Drawing Sheets

DEVELOPER CARTRIDGE

CROSS REFERENCE TO RELATED APPLICATION

The present application claims priority from Japanese Patent Application No. 2007-062029, which was filed on Mar. 12, 2007, the disclosure of which is herein incorporated by reference in its entirety.

TECHNICAL FIELD

The present invention relates to a developer cartridge having a memory chip.

BACKGROUND

In general, an image forming apparatus such as a laser printer includes a main body, a process cartridge having a developing roller, and a developer cartridge containing a toner. In the image forming apparatus, the developer cartridge can be attached to and detached from the process cartridge and the process cartridge can be attached to and detached from the main body of the apparatus.

A memory chip that stores a variety of information relating to the developer cartridge is disposed in the developer cartridge. When the developer cartridge is attached to the image forming apparatus through the process cartridge, the memory chip is electrically connected to a terminal disposed in the image forming apparatus body directly or through a conductive portion disposed in the process cartridge. In this way, the image forming apparatus acquires the variety of information stored in the memory chip.

As such a technology, a structure is known in which a panel-like cover covering a contact terminal of a memory chip is rotatably disposed in a developer cartridge (see Patent Document 1). When the developer cartridge is attached to a process cartridge, an end of the cover comes in contact with a part of the process cartridge and the other end of the cover pivots, whereby the contact terminal of the memory chip is exposed and is thus connected to a contact terminal of the process cartridge. According to this structure, since the contact terminal of the memory chip is covered with the cover in a state where the developer cartridge is not attached to the process cartridge, it is possible to prevent contamination or damage of the memory chip.

[Patent Document 1] Japanese Unexamined Patent Application Publication No. 2006-221010

SUMMARY

However, the above-described apparatus disclosed in Patent Document 1 has a following problem. Since a cover should be independent of existing parts (for example, a shutter for opening and closing a toner supply port) in the developer cartridge, there is a problem that the cartridge is complicated.

An object of the invention is to provide a developer cartridge which can suppress contamination or damage of a memory chip (memory unit) and which can simplify a configuration thereof.

In order to accomplish the above-mentioned object, according to an aspect of the invention, there is provided a developer cartridge that can be attached to and detached from an image forming apparatus and contains developer, the developer cartridge comprising: a first body that has an opening for supplying the developer; a second body that covers the first body, the second body having a conductive portion that can transmit electricity; and a memory unit that is disposed between the first body and the second body, the memory unit can be connected to a terminal of the image forming apparatus through the conductive portion of the second body, wherein the second body and the first body are movable relative to each other, the second body is able to open and close the opening by a relative movement with regard to the first body.

According to this configuration, since the memory unit is disposed between the first body and the second body and is connected to the terminal of the image forming apparatus through the conductive portion of the second body, the memory unit is always protected by the second body, thereby preventing contamination or damage thereof. That is, since the memory unit is hidden in the second body by only disposing the conductive portion in the outer body, the conventional particular mechanism is not necessary, thereby further simplifying the device configuration.

According to the invention, since the memory unit can be protected by the second body by only disposing the conductive portion in the second body, it is possible to prevent the contamination or damage of the memory unit and to further simplify the device configuration. Since the memory unit is protected by the second body serving as a shutter of the opening, it is possible to further simplify the device configuration.

BRIEF DESCRIPTION OF THE DRAWINGS

Illustrative aspects of the invention will be described in detail with reference to the following figures wherein:

FIG. 7A is a sectional view illustrating a relation between the memory chip and the conductive portion when the inner opening and the outer opening are closed, FIG. 7B is a sectional view illustrating a relation between the memory chip and the conductive portion when the inner opening and the outer opening communicate with each other, and FIG. 7C is a sectional view illustrating a relation among the memory chip, the conductive portion, and a terminal when the toner cartridge is attached to a main casing; FIG. 8A is a sectional view illustrating a relation between the memory chip and the conductive portion when the inner opening and the outer opening are closed, FIG. 8B is a sectional view illustrating a relation between the memory chip and the conductive portion when the inner opening and the outer opening communicate with each other, and FIG. 8C is a sectional view illustrating a relation among the memory chip, the conductive portion, and a terminal when the toner cartridge is attached to a main casing.

DETAILED DESCRIPTION OF THE PREFERRED EMBODIMENTS

Figure 1:
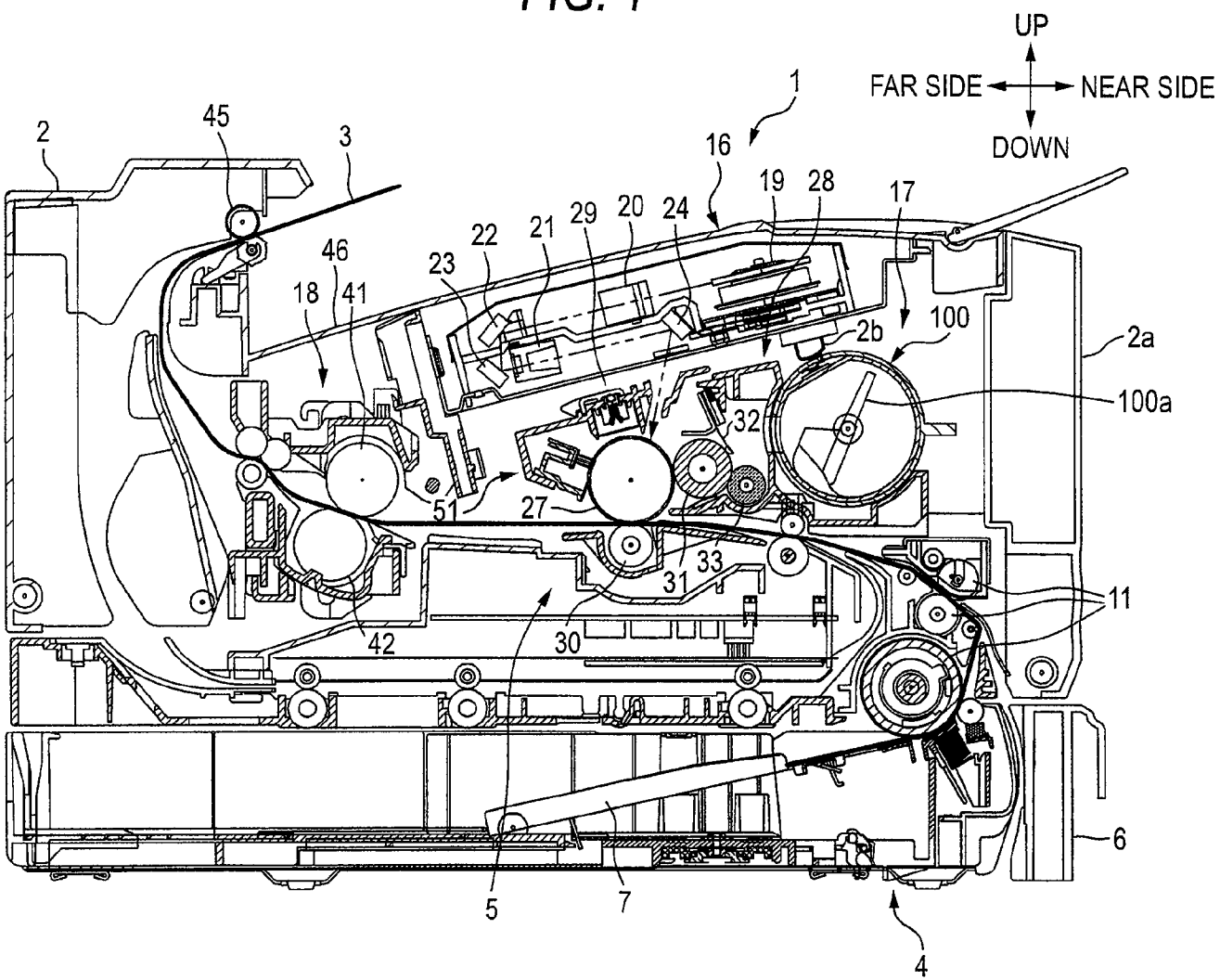
FIG. 1 is a side sectional view illustrating a laser printer according to an embodiment of the invention.

Hereinafter, an exemplary embodiment of the invention will be described in detail with reference to the attached drawings. FIG. 1 is a side sectional view illustrating a laser printer according to an exemplary embodiment of the invention. In the following description, the entire configuration of a laser printer is first explained in brief and then detailed features of the invention will be explained. In the following description, directions are based on a user using a laser printer 1. That is, in FIG. 1, the right side is defined as a "near side", the left side is defined as a "far side", the far side in the direction perpendicular to the sheet surface is defined as a "right side", and the near side in the direction perpendicular to the surface of the fig sheet is defined as a"left side." Since the vertical direction shown in the figures is equal to the vertical direction at the time when the user uses the apparatus, the vertical direction is defined as a "vertical direction."

<Entire Configuration of Laser Printer>

As shown in FIG. 1, a laser printer 1 as an example of the image forming apparatus includes a feeder unit 4 that feeds a sheet 3 into a main casing 2 as an example of a main body of the apparatus and an image forming unit 5 that forms an image on the fed sheet 3.

<Configuration of Feeder Unit>

The feeder unit 4 includes a sheet feeding tray 6 that is detachably attached to the bottom of the main casing 2 and a sheet pressing plate 7 that is disposed in the sheet feeding tray 6. The feeder unit 4 further includes various rollers 11 that conveys the sheet 3 or removes sheet powders.

In the feeder unit 4 having the above-mentioned configuration, the sheet 3 in the sheet feeding tray 6 is sent to the upper side of the sheet pressing plate 7 and is conveyed to the image forming unit 5 by the various rollers 11.

<Configuration of Image Forming Unit>

The image forming unit 5 includes a scanner unit 16, a process cartridge 17, and a fixing unit 18.

<Configuration of Scanner Unit>

The scanner unit 16 is disposed in the upper portion of the main casing 2 and includes a laser-emitting portion (not shown), a polygon mirror 19 that is rotationally driven, lenses 20 and 21, and reflecting mirrors 22, 23, and 24. A laser beam based on image data and emitted from the laser-emitting portion is transmitted or reflected by the polygon mirror 19, the lens 20, the reflecting mirror 22, the reflecting mirror 23, the lens 21, and the reflecting mirror 24 in this order as indicated by a dotted line and then is applied to the surface of a photosensitive drum 27 of the process cartridge 17 at a high speed.

<Configuration of Process Cartridge>

The process cartridge 17 is detachably attached to the main casing 2 when a front cover 2*a*, which is disposed in the front of the main casing 2, opens. The process cartridge 17 includes a developing cartridge 28 and a drum unit 51.

The developing cartridge 28 can be attached to and detached from the main casing 2 in a state where it is fitted to the drum unit 51. The developing cartridge 28 maybe freely attached to and detached from the drum unit 51 fixed to the main casing 2.

The developing cartridge 28 includes a toner cartridge 100 that can be attached to and detached from the developing cartridge, a developing roller 31, a thickness regulating blade 32, and a supply roller 33. A toner in the toner cartridge 100 is agitated by an agitator 100*a* and is then supplied to the developing roller 31 by the supply roller 33. At this time, the toner is frictionally charged positive between the supply roller 33 and the developing roller 31. The toner supplied to the developing roller 31 enters between the thickness regulating blade 32 and the developing roller 31 and is held as a thin layer having a constant thickness on the developing roller 31, with the rotation of the developing roller 31.

The drum unit 51 includes a photosensitive drum 27, a scorotron charging unit 29, and a transfer roller 30.

The photosensitive drum 27 is rotatably supported in the body of the drum unit 51.

The scorotron charging unit 29 is a positive scorotron charging unit for generating a corona discharge from a charging wire made of tungsten or the like and serves to charge the surface of the photosensitive drum 27 to be uniformly positive.

The transfer roller 30 is disposed below the photosensitive drum 27 so as to come in opposed contact with the photosensitive drum 27. And the transfer roller 30 is rotatably supported in the body of the drum unit 51. A transfer bias is applied to the transfer roller 30 based on the static current control at the time of transfer.

The surface of the photosensitive drum 27 is uniformly charged positive by the scorotron charging unit 29 and then is exposed to a laser beam from the scanner unit 16 at a high speed. Accordingly, the potential of the exposed portion is lowered to form an electrostatic latent image based on image data. Here, the "electrostatic latent image" means an exposed portion which is exposed to the laser beam and is lowered in potential on the surface of the photosensitive drum 27 uniformly charged positive. And, with the rotation of the developing roller 31, the toner held on the developing roller 31 is supplied to the electrostatic latent image formed on the surface of the photosensitive drum 27 at the time of coming in contact with the photosensitive drum 27. The toner is selectively held on the surface of the photosensitive drum 27 and is visualized, thereby forming a toner image by an inversion phenomenon.

Thereafter, the photosensitive drum 27 and the transfer roller 30 are rotationally driven to convey a sheet 3 therebetween. By conveying the sheet 3 between the photosensitive drum 27 and the transfer roller 30, the toner image held on the surface of the photosensitive drum 27 is transferred to the sheet 3.

<Configuration of Fixing Unit>

The Fixing unit 18 is disposed on the downstream side of the process cartridge 17 and includes a heating roller 41 and a pressing roller 42 that is opposed to the heating roller 41 so as to press the heating roller 41. The fixing unit 18 thermally fixes the toner transferred to the sheet 3 while the sheet 3 passes between the heating roller 41 and the pressing roller 42. The sheet 3 thermally fixed by the fixing unit 18 is conveyed to the discharge roller 45 disposed on the downstream side of the fixing unit 18 and is sent to a sheet discharging tray 46 by the discharge roller 45.

<Structure of Toner Cartridge>

Figure 2:
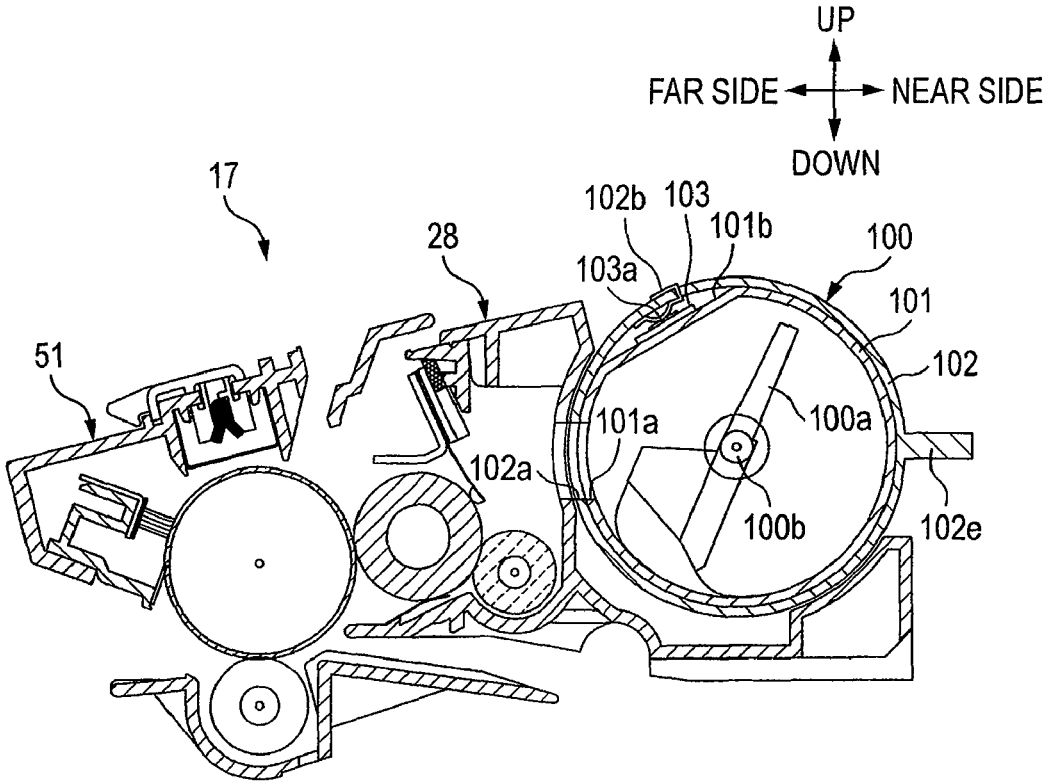
FIG. 2 is a sectional view illustrating a process cartridge according to an embodiment of the invention.
Figure 3:
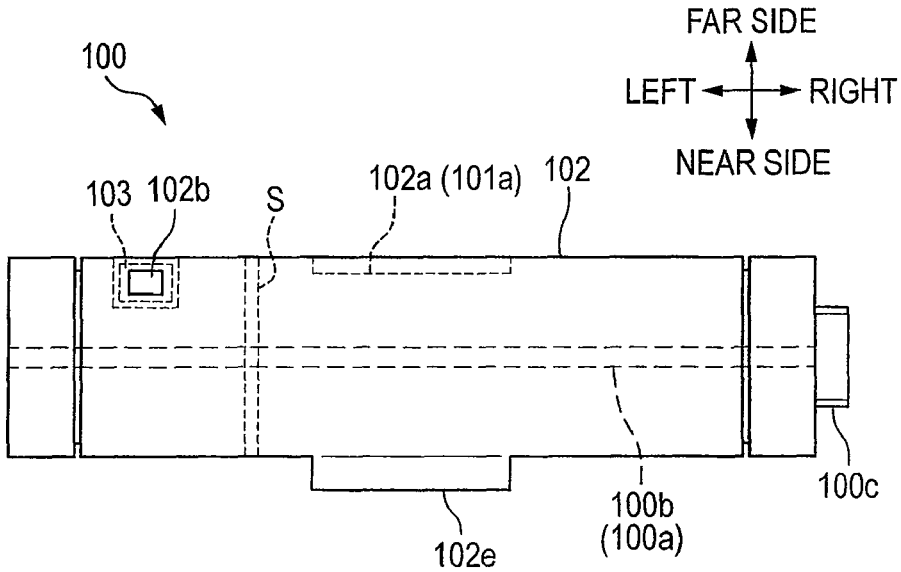
FIG. 3 is a plan view illustrating a toner cartridge.
Figure 4A:
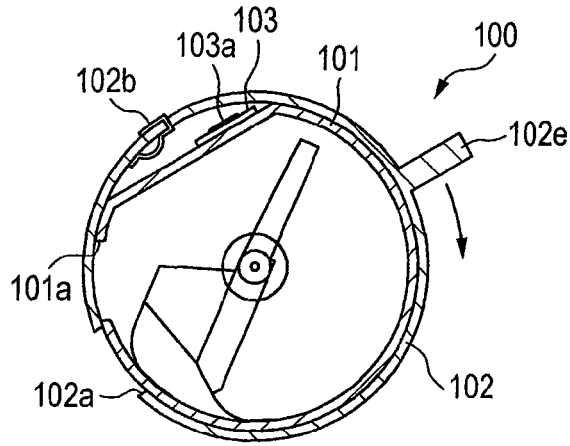
FIG. 4A is a sectional view illustrating a relation between a memory chip and a conductive portion when an inner opening and an outer opening are closed.
Figure 4B:
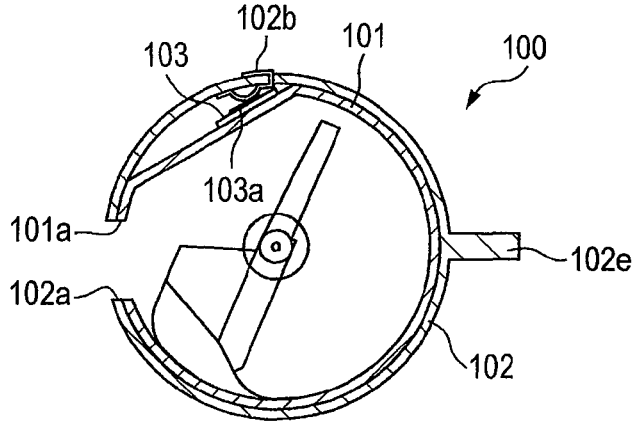
FIG. 4B is a sectional view illustrating a relation between the memory chip and the conductive portion when the inner opening and the outer opening communicate with each other.
Figure 4C:
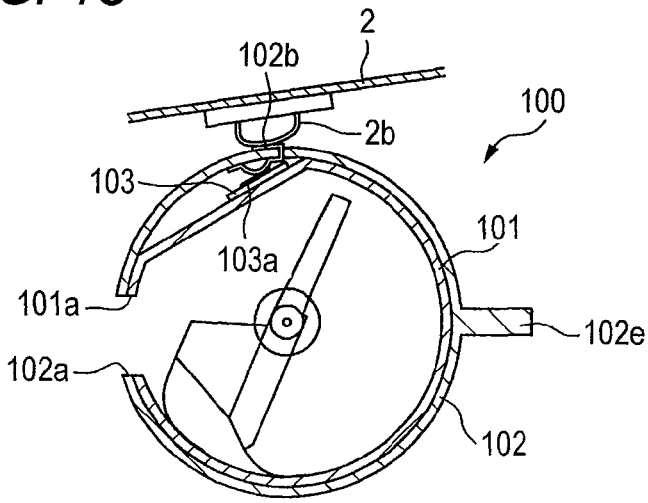
FIG. 4C is a sectional view illustrating a relation among the memory chip, the conductive portion, and a terminal when the toner cartridge is attached to a main casing.

Next, a detailed structure of the toner cartridge 100 as an example of the developer cartridge according to an embodiment of the invention will be described. FIG. 2 is a sectional view illustrating a process cartridge according to an embodiment of the invention. FIG. 3 is a plan view illustrating a toner cartridge. FIG. 4A is a sectional view illustrating a relation between a memory chip and a conductive portion when an inner opening and an outer opening are closed, FIG. 4B is a sectional view illustrating a relation between the memory chip and the conductive portion when the inner opening and the outer opening communicate with each other, and FIG. 4C is a sectional view illustrating a relation among the memory chip, the conductive portion, and a terminal when the toner cartridge is attached to a main casing.

As shown in FIG. 2, the toner cartridge 100 constitutes a process cartridge 17 along with the developing cartridge 28 and the drum unit 51. And the toner cartridge 100 is detachably attached to the main casing 2 in a state where it is attached to the developing cartridge 28. Specifically, as shown in FIG. 3, the toner cartridge 100 includes an inner body 101 that contains a toner T, an outer body 102 that is movable relative to the inner body 101, and a memory chip 103 as an example of the memory unit disposed between the inner body 101 and the outer body 102. Here, the memory chip 103 stores a variety of information such as an amount of toner contained in the toner cartridge 100. The variety of information is read by a reading device disposed in the main casing 28 and is used to perform various control operations for the laser printer 1.

The inner body 101 is formed in a hollow cylinder shape and is rotatably supported by a cylindrical inner circumferential surface of the outer body 102. An inner opening 101*a* for supplying the toner T to the developing cartridge 28 is formed at a far position on a cylindrical outer circumferential surface of the inner body 101. A flat seat portion 101*b* on which the memory chip 103 is disposed is formed at a far upper position on the cylindrical outer circumferential wall of the inner body 101. The inner body 101 is fixed to the developing cartridge 28.

The outer body 102 is formed in a hollow cylinder shape and an outer opening 102*a* that can communicate with the inner opening 101*a* of the inner body 101 is formed at a far position on a cylindrical outer circumferential wall thereof. A conductive portion 102*b* that can transmit electricity is formed at a far upper position on the cylindrical outer circumferential wall of the outer body 102 from the outer circumferential surface of the outer body 102 to the inner circumferential surface. The conductive portion 102*b* can be connected to a contact terminal 103*a* of the memory chip 103 and a wire-shaped terminal 2*b* disposed in the main casing 2 shown in FIG. 1 when the inner opening 101*a* of the inner body 101 communicates with the outer opening 102*a* of the outer body 102. The conductive portion 102*b* can be formed integrally with the outer body 102 by performing an insert molding process on a metal plate having a predetermined shape with a resin.

As shown in FIG. 3, a drive delivery portion 100*c*, which is fixed to the right end of a rotation shaft 100 *b* of an agitator 100*a* disposed to be rotatable relative to the inner body 101 and the outer body 102, is disposed on the right end surface of the outer body 102. When power is supplied to the drive delivery portion 100*c* from the main casing 2 side, the agitator 100*a* rotates. A grip portion 102*e* is disposed on the front side of the outer circumferential surface of the outer body 102. The grip portion 102*e* is a portion gripped by a user and is formed to protrude forward from the center in the axis direction of the outer body 102. Since the conductive portion 102*b* is disposed on the left side of the outer body 102, the grip portion 102*e* is disposed at a position deviating in the axis direction of the agitator 100*a* from the conductive portion 102*b*.

As shown in FIG. 2, the memory chip 103 is an example of the memory unit and is fixed to the seat portion 101*b* of the inner body 101 in a state where the contact terminal 103*a* thereof faces the outside in the diameter direction of the inner body 101. Accordingly, as shown in FIG. 4A, the contact terminal 103*a* of the memory chip 103 is separated from the conductive portion 102*b*, when the inner opening 101*a* and the outer opening 102*a* are closed. And, as shown in FIG. 4B, the contact terminal 103*a* comes in contact with the conductive portion 102*b*, when the inner opening 101*a* communicates with the outer opening 102*a*. As shown in FIG. 3, while the drive deliver portion 100*c* is disposed at the right end of the rotation shaft 100*b* of the agitator 100*a*, the memory chip 103 is disposed at the left end of the rotation shaft 100*b*. Accordingly, the vibration of the drive delivery portion 100*c* is hardly transmitted to the memory chip 103.

A sealing member S for preventing the movement of toner from the inner opening 101*a* to the memory chip 103 is disposed between the inner body 101 and the outer body 102, that is, between the memory chip 103 and the inner opening 101*a*.

Next, a relation among the memory chip 103, the conductive portion 102*b*, and the terminal 2*b* disposed on the main casing 2 will be described.

First, as shown in FIG. 4A, when the inner opening 101*a* of the inner body 101 and the outer opening 102*a* of the outer body 102 are closed, for example, when the toner cartridge 100 remains as a single product, the contact terminal 103*a* of the memory chip 103 is separated from the conductive portion 102*b*. Accordingly, in this state, even when the toner cartridge 100 is attached to the main casing 2 through the developing cartridge 28 or the like, the memory chip 103 is not electrically connected to the terminal 2*b* of the main casing 2.

When the grip portion 102*e* is made to move down by a predetermined distance from the state shown in FIG. 4A, the inner opening 101*a* of the inner body 101 and the outer opening 102*a* of the outer body 102 communicate with each other and the contact terminal 103*a* of the memory chip 103 is connected to the conductive portion 102*b*, as shown in FIG. 4B. Accordingly, as shown in FIG. 4C, the toner can be supplied from the toner cartridge 100 to the developing cartridge 28 (see FIG. 2) and the memory chip 103 is electrically connected to the terminal 2*b* of the main casing 2 through the conductive portion 102*b*.

According to the above-mentioned embodiment, the following advantages can be obtained.

Since the memory chip 103 can be protected by the outer body 102 by only disposing the conductive portion 102*b* in the outer body 102, it is possible to prevent the contamination or damage of the memory chip 103 and to further simplify the device configuration. By electrically connecting the memory chip 103 to the terminal 2*b* of the main casing 2 through the conductive portion 102*b* disposed in the outer body 102, the memory chip 103 can be always covered with the outer body 102, thereby protecting the memory chip 103 better.

When the inner opening 101*a* and the outer opening 102*a* are closed, the contact terminal 103*a* of the memory chip 103 is not electrically connected to the terminal 2*b* of the main casing 2 and thus the laser printer 1 does not work, thereby informing a user that the inner opening 101*a* and the outer opening 102*a* do not communicate with each other. That is, since the information of the memory chip 103 can be read by the laser printer 1 after the inner opening 101*a* and the outer opening 102*a* have communicated with each other so as to supply the toner from the toner cartridge 100 to the developing cartridge 28, it is possible to suppress an erroneous operation of the laser printer 1.

The grip 102*e* is disposed at a position deviating in the axis direction of the agitator 100*a* from the conductive portion 102*b*. Accordingly, even when a user handles the toner cartridge 100 with a wet handle, it is possible to prevent the conductive portion 102*b* from getting wet.

While the drive delivery portion 100*c* is disposed at the right end of the rotation shaft 100*b* of the agitator 100*a*, the memory chip 103 is disposed at the left end of the rotation shaft 100*b*. Accordingly, the vibration of the drive delivery portion 100*c* is hardly transmitted to the memory chip 103, thereby elongating the lifetime of the memory chip 103.

Since the sealing member S is disposed between the inner body 101 and the outer body 102 and between the memory chip 103 and the inner opening 101*a*, it is possible to suppress the contamination of the memory chip 103 due to the toner.

The invention is not limited to the above-mentioned embodiment, but may be modified in various forms as described below.

Figure 5:
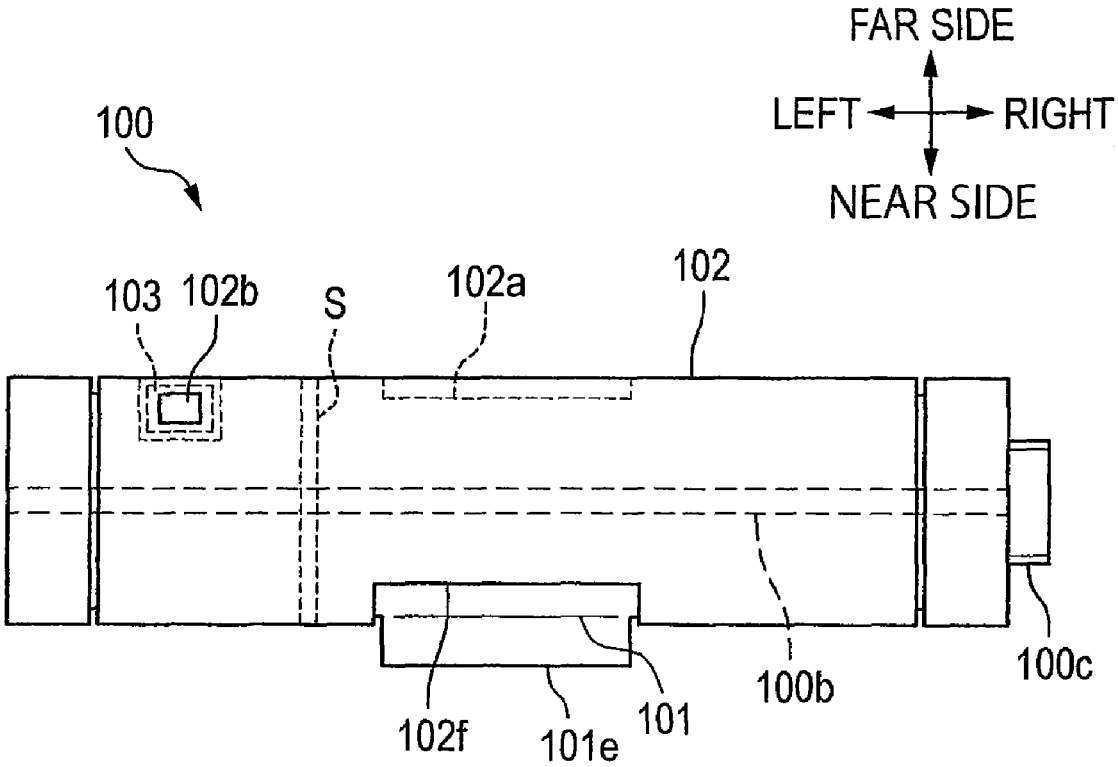
FIG. 5 is a plan view illustrating a toner cartridge according to another embodiment of the invention.
Figure 6A:
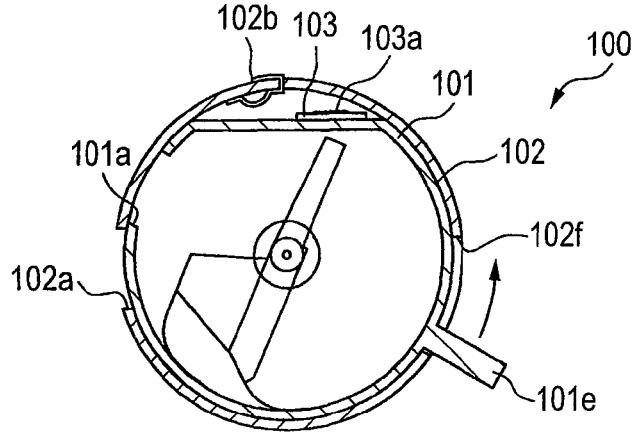
FIG. 6A is a sectional view illustrating a relation between the memory chip and the conductive portion when the inner opening and the outer opening are closed in the example shown in FIG. 5.
Figure 6B:
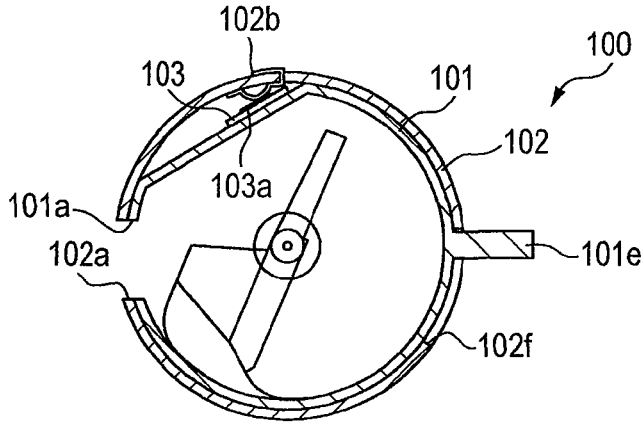
FIG. 6B is a sectional view illustrating a relation between the memory chip and the conductive portion when the inner opening and the outer opening communicate with each other.
Figure 6C:
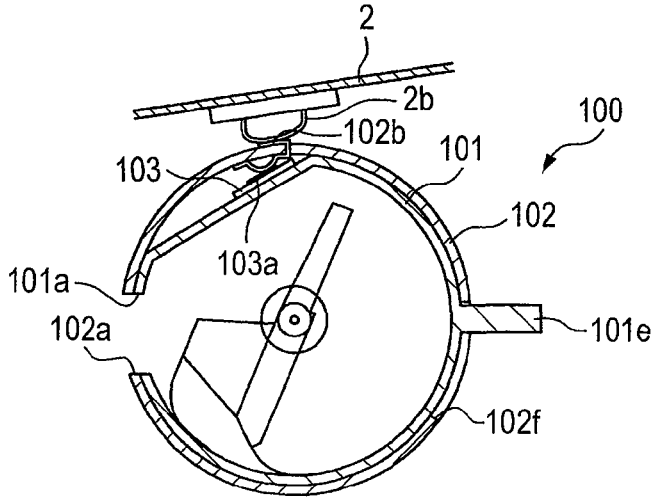
FIG. 6C is a sectional view illustrating a relation among the memory chip, the conductive portion, and a terminal when the toner cartridge is attached to a main casing.

Although it has been described in the embodiment that the inner body 101 is fixed to the developing cartridge 28 and the outer body 102 is made to rotate relative to the inner body 101, the invention is not limited to the configuration. On the contrary, the outer body 102 may be fixed to the developing cartridge 28 and the inner body 101 may be made to rotate relative to the outer body 102. Specifically, for example, as shown in FIG. 5, a grip portion 101*e* extending to the near side may be disposed on the near side of the center in the axis direction of the inner body 101 and a clearance groove 102*f* permitting the movement of the grip portion 101*e* in the circumferential direction thereof may be disposed at the center in the axis direction of the outer body 102. In this case, as shown in FIG. 6A, when the inner opening 101*a* and the outer opening 102*a* are closed, the contact 103*a* of the memory chip 103 can be separated from the conductive portion 102*b*. As shown in FIG. 6B, when the inner opening 101*a* and the outer opening 102*a* communicate with each other, the contact terminal 103*a* of the memory chip 103 can be brought into contact with the conductive portion 102*b* by making the grip portion 101*e* move upward from the state shown in FIG. 6A to rotate the inner body 101 relative to the outer body 102. That is, as shown in FIG. 6C, when the inner opening 101*a* and the outer opening 102*a* communicate with each other, the contact terminal 103*a* of the memory chip 103 can be connected to the terminal 2*b* of the main casing 2 through the conductive portion 102*b*.

Although it has been described in the embodiment that the memory chip 103 is disposed on the outer circumferential surface of the inner body 101, the invention is not limited to it, but the memory chip 103 may be disposed on the inner circumferential surface of the outer body 102. Specifically, for example, as shown in FIGS. 7 and 8, the memory chip 103 may be fixed to the inner circumferential surface of the outer body 102 in a state where the contact terminal 103*a* thereof faces the inside in the diameter direction and a conductive portion 102*b*' formed from the inner circumferential surface of the outer body 102 to the outer circumferential surface may be connected to the contact 103*a*. In this structure, the outer body 102 may be made to rotate by means of the operation of the grip portion 102*e* disposed in the outer body 102 as shown in FIG. 7, or the inner body 101 may be made to rotate by means of the operation of the grip portion 101*e* disposed in the inner body 101 as shown in FIG. 8. According to this structure, since the contact terminal 103*a* of the memory chip 103 is always connected to the conductive portion 102*b*', the electrical connection between the contact 103*a* of the memory chip 103 and the conductive portion 102*b*' can be obtained more reliably.

Figure 7A:
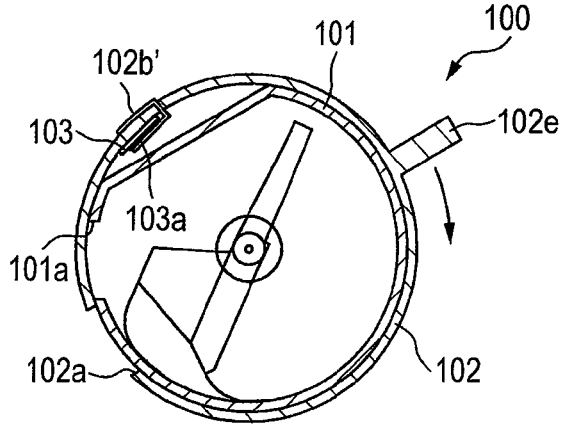
FIG. 7A to FIG. 7C are diagrams illustrating an example where the conductive portion is always connected to the contact terminal of the memory chip.
Figure 7B:
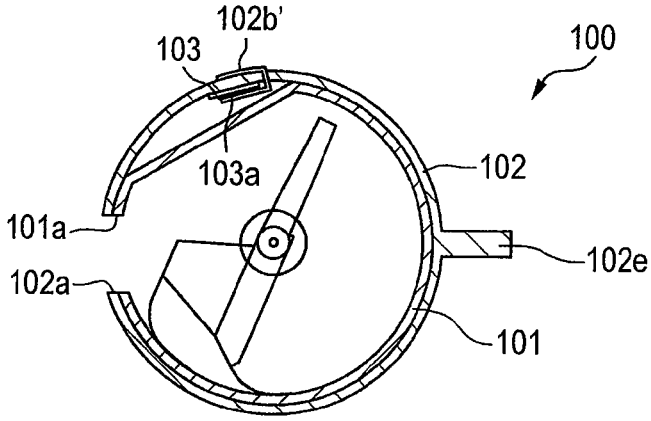
Figure 7C:
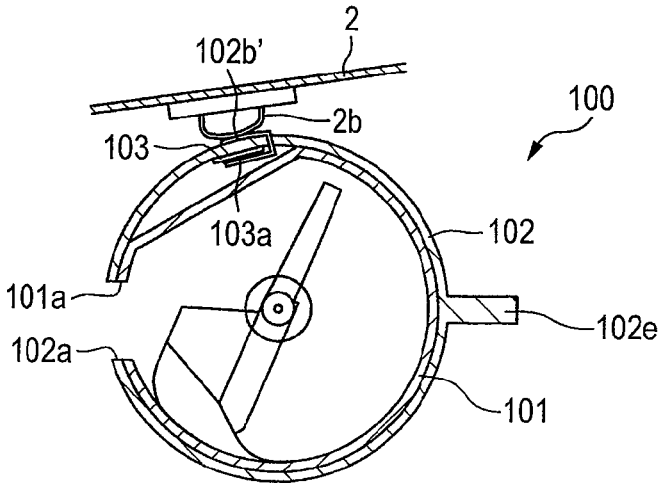
Figure 8A:
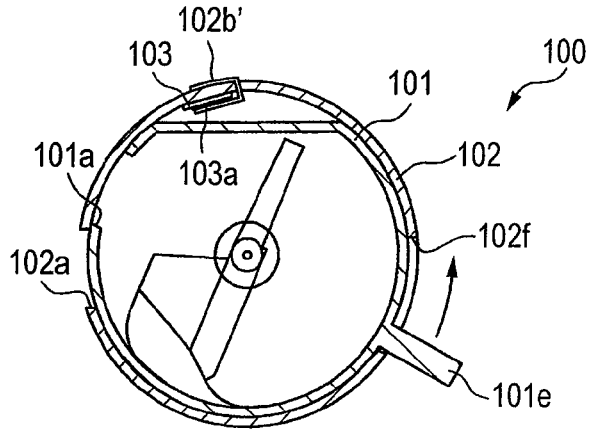
FIG. 8A to FIG. 8C are diagrams illustrating a modified example of the example shown in FIG. 7.
Figure 8B:
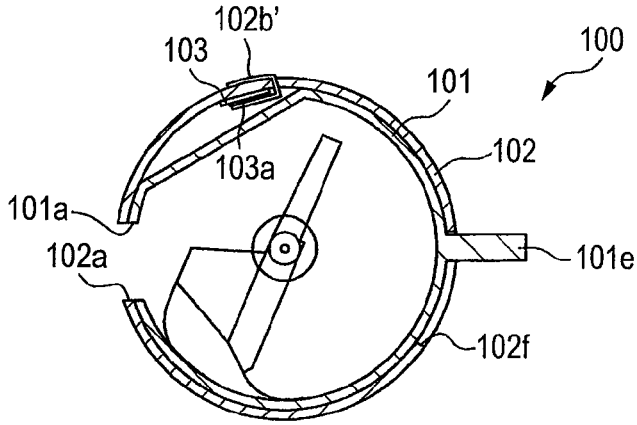

In the example shown in FIG. 7, as shown in FIGS. 7A and 7C, the conductive portion 102*b*' can be connected to and disconnected from the terminal 2*b* of the main casing 2 by means of the rotation of outer body 102. That is, as shown in FIG. 7A, the conductive portion 102*b*' is disposed at the position which does not permit the contact with the terminal 2*b* of the main casing 2, when the inner opening 101*a* and the outer opening 102*a* are closed. As shown in FIGS. 7B and 7C, the conductive portion 102*b*' is disposed at a position which can permit the contact with the terminal 2*b* of the main casing 2, when the inner opening 101*a* and the outer opening 102*a* communicate with each other. Accordingly, in this example, similarly to the above-mentioned embodiment, since the information of the memory chip 103 can be read by the laser printer 1 after the inner opening 101*a* and the outer opening 102*a* have communicated with each other so as to supply the toner from the toner cartridge 100 to the developing cartridge 28, it is possible to suppress an erroneous operation of the laser printer 1.

Figure 8C:
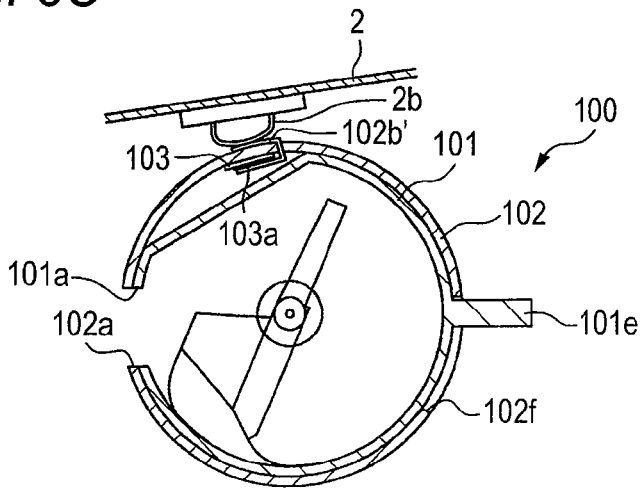

In comparison with the example shown in FIG. 7, since the example shown in FIG. 8 shows a structure for the inner body 101 relative to the outer body 102, the conductive portion 102*b*' is disposed at a position which can always permit the contact with the terminal 2*b* of the main casing 2, as shown in FIG. 8C. That is, the conductive portion 102*b*' can be more reliably brought into contact with the terminal 2*b* of the main casing 2.

Although it has been described in the above-mentioned embodiment that the toner cartridge 100 is attached to the main casing 2 in a state where the developing cartridge 28 and the drum unit 51 is incorporated into a bundle, the invention is not limited to the configuration. For example, when the parts of the developing cartridge 28 are fixed to the main casing 2, the toner cartridge 100 may be attached directly to the main casing 2.

Although it has been described in the embodiment that the developing cartridge 28 is freely attached to and detached from the drum unit 51, the developing cartridge 28 and the drum unit 51 may be formed in a bundle (not separable).

Although the invention has been applied to the laser printer 1 in the above-mentioned embodiment, the invention is not limited to it, but the invention may be applied to other image forming apparatus such as copiers or multi-function devices.

Although it has been described in the embodiment that the inner body 101 and the outer body 102 are formed in a hollow cylinder shape and the inner body 101 rotates relative to the outer body 102, the invention is not limited to it. For example, the inner body and the outer body may be both in a hollow rectangular shape and the inner body and the outer body may be made to move relative to each other along a predetermined side thereof.

Although it has been described in the above-mentioned embodiment that the toner cartridge 100 contains a positively-charging developer, the toner cartridge may contain a negatively-charging developer.

What is claimed is:

1. A developer cartridge that can be attached to and detached from an image forming apparatus and contains developer, the developer cartridge comprising:

a first body that has an opening for supplying the developer;

a second body that covers the first body, the second body having a conductive portion that can transmit electricity; and a memory unit that is disposed between the first body and the second body, the memory unit can be connected to a terminal of the image forming apparatus through the conductive portion of the second body, wherein the second body and the first body are movable relative to each other, the second body is able to open and close the opening by a relative movement with regard to the first body.

2. The developer cartridge according to claim 1, wherein an electrical connection between the memory unit and the terminal of the image forming apparatus is broken when the opening is closed by the second body, and wherein the memory unit is electrically connected to the terminal of the image forming apparatus through the conductive portion when the opening is opened.

3. The developer cartridge according to claim 2, wherein the memory unit is disposed on the outer circumferential surface of the first body, the memory unit is disconnected from the conductive portion of the second body when the opening is closed by the second body, the memory unit is in contact with the conductive portion of the second body so as to be connected to the terminal of the image forming apparatus when the opening is opened.

4. The developer cartridge according to claim 2, wherein the memory unit is disposed on the inner circumferential surface of the second body so as to be connected to the conductive portion, and wherein the conductive portion of the second body can be connected to and disconnected from the terminal of the image forming apparatus with the movement of the second body.

5. The developer cartridge according to claim 1, wherein the first body is formed in a hollow cylinder shape, the first body comprises a grip portion gripped by a user, and wherein the conductive portion on the outer circumferential surface of the second body is located at a position which deviates in the axis direction of the first body from the grip portion.

6. The developer cartridge according to claim 1, wherein the first body includes an agitator that agitates the developer and a drive delivery portion that is fixed to an end of the agitator, and wherein the memory unit is disposed at a position close to the other end of the agitator.

7. The developer cartridge according to claim 1, wherein a sealing member that suppresses the movement of the developer from the opening to the memory unit is disposed between the first body and the second body.

* * * * *